US007258142B2

(12) United States Patent
Willmer et al.

(10) Patent No.: US 7,258,142 B2
(45) Date of Patent: Aug. 21, 2007

(54) METHOD FOR CORRECTIVELY CONTROLLING GAS RECIRCULATION SYSTEM AT FILLING STATION

(75) Inventors: Klaus Willmer, Hamburg (DE); Stefan Kunter, Hamburg (DE); Christian Maurer, Hamburg (DE); Wolfgang Schrittenlacher, Hamburg (DE)

(73) Assignee: Fafnir GmbH, Hamburg (DE)

( * ) Notice: Subject to any disclaimer, the term of this patent is extended or adjusted under 35 U.S.C. 154(b) by 352 days.

(21) Appl. No.: 10/918,398

(22) Filed: Aug. 16, 2004

(65) Prior Publication Data

US 2005/0045243 A1 Mar. 3, 2005

(30) Foreign Application Priority Data

Aug. 14, 2003 (DE) ..... 103 37 800

(51) Int. Cl.
*B65B 31/00* (2006.01)

(52) U.S. Cl. ..... 141/7; 141/59; 141/83; 141/94

(58) Field of Classification Search ..... 141/4–7, 141/59, 65, 67, 83, 94, 95, 98, 285, 301, 141/44–46
See application file for complete search history.

(56) References Cited

U.S. PATENT DOCUMENTS

| | | | | |
|---|---|---|---|---|
| 5,280,814 | A * | 1/1994 | Stroh | 141/83 |
| 5,332,008 | A * | 7/1994 | Todd et al. | 141/5 |
| 5,355,915 | A | 10/1994 | Payne | |
| 6,047,745 | A | 4/2000 | Fournier | |
| 6,460,579 | B2 * | 10/2002 | Nanaji | 141/59 |

FOREIGN PATENT DOCUMENTS

| | | |
|---|---|---|
| DE | 42 00 803 | 7/1993 |
| DE | 199 18 926 | 1/2000 |
| EP | 653 376 | 5/1995 |
| WO | 95/09805 | 4/1995 |
| WO | 9606038 | 2/1996 |

* cited by examiner

*Primary Examiner*—Timothy L. Maust
(74) *Attorney, Agent, or Firm*—Staas & Halsey LLP

(57) ABSTRACT

A gas recirculation system at a filling station is controlled during a refuelling process by generating a corrective control signal used for the next refuelling process, to actuate the gas recirculation system and control the gas volume flow, based on the fuel volume flow signal and the gas volume flow signal as well as optionally further signals.

34 Claims, 1 Drawing Sheet

METHOD FOR CORRECTIVELY CONTROLLING GAS RECIRCULATION SYSTEM AT FILLING STATION

Figure 1:
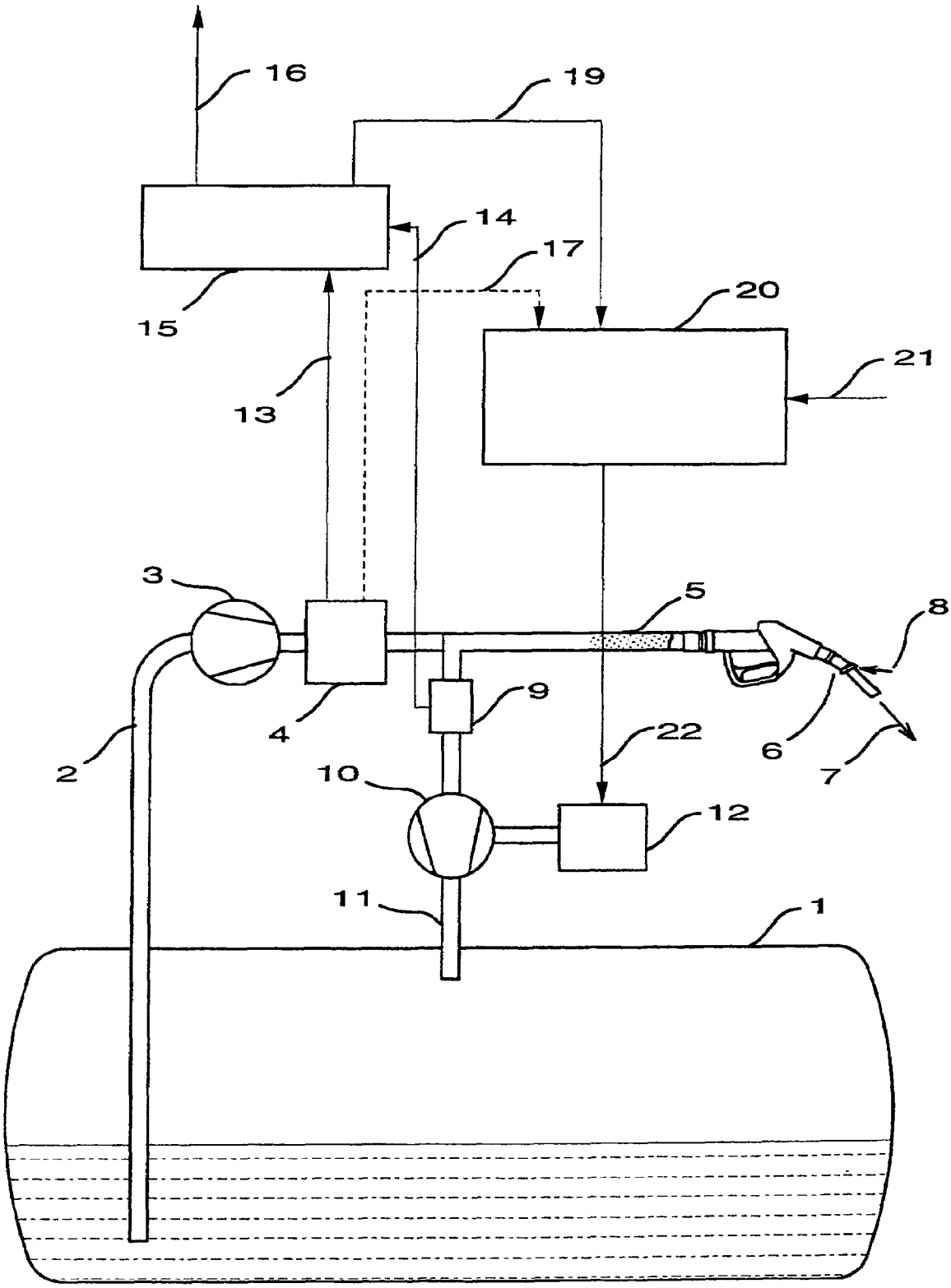

The invention relates to a method for correctively controlling a gas recirculation system at a filling station.

When a motor vehicle is refuelled at a filling station, fuel is filled into the tank of the motor vehicle from the fuel pump using a filling valve. At the same time, the gas mixture which is located above the liquid level of the fuel in the tank of the motor vehicle is sucked away via a separate line and recirculated into the fuel storage tank. The gas recirculation system which is used for this purpose has to be controlled in such a way that the volume of gas mixture which is sucked away per time unit is equal to the volume of fuel which is filled into the tank of a motor vehicle per time unit.

According to the prior art, a standardization procedure is used for this purpose, in which procedure air is pumped as a comparative gas through the gas recirculation system. A gas throughflow meter is connected to the gas inlet opening of the filling valve and a control parameter is determined in such a way that the gas volume which is recirculated corresponds to the assumed volume of fuel. This control parameter is determined for various fuel throughput rates which are assumed, and the resulting standardization data is stored in the operating electronics of the gas recirculation system. In the refuelling mode, the delivery capacity of the gas recirculation system is set using the standardization data.

Changes in the gas recirculation system, for example due to ageing, can bring about considerable deviations of the gas volume flow from the fuel volume flow, which leads to increased environmental stress. In the past, these deviations have generally not been discovered until annual routine inspections. For this reason, in various countries, automatic monitoring devices have already been prescribed or will be in future. Such automatic monitoring devices measure the gas volume flow during each refuelling process and compare it with the fuel volume flow. When there is a deviation above the respectively prescribed limits, an alarm signal is generated. Such monitoring devices are described, for example, in DE 100 31 813 A1, DE 100 35 645 A1, EP 1 077 197 A1 and WO 98/31628. In the configuration described, the gas recirculation system and the automatic monitoring device operate independently of one another.

Since degradation occurs during which the gas recirculation rate changes only moderately and slowly but nevertheless the previously defined limits are exceeded, in further developed systems the measured value of the gas recirculation rate is used to correct the gas recirculation system. Such devices are described in WO 96/06038, DE 295 21 160 A1 and DE 199 18 926 A1.

WO 96/06038 and DE 295 21 160 A1 present a control system which however has the disadvantage that the gas volume flow meter and the control system have to have short time constants in order to ensure appropriately timed control.

This disadvantage is eliminated by the device according to DE 199 18 926 A1. Here, a new set of calibration data is calculated after each refuelling process from the gas volume flow measured values and said set is then transmitted to the gas recirculation system and stored there. During the respectively following refuelling process, there is then available a new calibration dataset which compensates for a deviation which may have occurred between the gas recirculation rate and the reference rate of 100%. However, the comparison with the fuel volume flow is still carried out, as in the past, independently by this gas recirculation system; the gas volume flow meter is used virtually only for selecting the suitable standardization data. The disadvantage of this solution which is described in DE 199 18 926 A1 is that only a small number of the installed gas recirculation systems are designed to permit constant reloading of the modified standardization data. There are various manufacturer-specific standardization data formats which are not disclosed.

The object of the invention is to provide a reliable method for controlling/regulating a gas recirculation system at a filling station which can be carried out by cost-effective retrofitting of existing installations without manufacturer-specific changes to the existing gas recirculation systems becoming necessary.

This object is achieved by means of a method for correctively controlling a gas recirculation system at a filling station having the features of Claim 1. Advantageous refinements of the invention emerge from the other claims.

In the method according to the invention, in a refuelling process by means of the fuel volume flow signal and gas volume flow signal which is generated by means of the gas volume flow meter which is present, and if appropriate further signals, in a control device a corrective control signal is generated which is to be used for the next refuelling process and with which the gas recirculation system is actuated in order to control the gas volume flow. In contrast to the prior art (DE 199 18 926 A1), the gas volume flow meter is therefore not used to select a suitable set of standardization data (relationship between gas volume flow as a function of the directly measured fuel volume flow), by means of which the gas pump is then actuated, but instead the gas volume flow signal is used directly, virtually as in a control system. Control fluctuations, such as can occur in the prior art according to WO 96/06038 and DE 295 21 160 A1 are however avoided since the corrective control signal which is generated is not used until the next refuelling process. The method is therefore a control, but at the same time a corrective control.

If the corrective control signal which is to be used for the next refuelling process is calculated by forming mean values of deviation signals over a plurality of refuelling processes, particularly stable relationships come about, and short-term fluctuations cannot lead to problems.

The method according to the invention is well suited for cost-effective retrofitting of existing gas recirculation systems. Depending on the conditions present, a refitting set may include, for example, the control device or replacement parts for an existing control device (plug-in cards, programme modules) or even a gas volume flow meter.

The invention is explained below in more detail with reference to exemplary embodiments. In the drawing, FIG. 1 shows a schematic view of a gas recirculation system at a filling station having the components which are used for carrying out the method according to the invention In a refuelling system fuel is fed, as is known from the prior art, from a fuel storage tank 1 through a line 2, using a fuel pump 3, through a fuel volume flow meter 4, a filling hose 5 and a filling valve 6, until said fuel emerges through an opening 7 and runs into the fuel tank of the motor vehicle (not illustrated) to be refuelled. The gas mixture which is located above the fuel in the tank to be filled is forced out of the storage tank by the fuel and is sucked in via an intake opening 8 of the filling valve 6. The magnitude of the gas volume flow is determined by the delivery capacity of the gas pump 10 used. This delivery capacity is adjusted, for example, by means of the rotational speed of the electrical drive motor 12 of the gas pump 10. The gas mixture flows back into the fuel storage tank 1 through a line within the filling hose 5 and via a recirculation line 11. It is also customary to adjust the delivery capacity by means of a throttle valve which is installed upstream of the gas pump 10 in the gas recirculation line (and is not illustrated). In this case, the drive motor 12 of the gas pump 10 operates at a constant rotational speed. The drive motor 12 is actuated by means of an electronic operating system 20.

According to the prior art, a fuel volume flow signal 13 is transmitted to this electronic operating system 20. This is shown in FIG. 1 by a connection 17 which is indicated by dashed lines. The electronic operating system 20 controls the drive motor 12 of the gas pump 10 via a control line 22 in such a way that in an ideal case the rotational speed of the drive motor 12 generates, with the gas pump 10, a gas volume flow which is equal to the fuel volume flow.

In the prior art, this is brought about by means of a standardization procedure in which a gas throughflow meter is connected to the intake opening 8 using an adapter (not illustrated). This gas throughflow meter is connected to a control unit which is connected via an electrical connection to a standardization connection 21 of the electronic operating system 20. The control unit sets various gas volume flows of the gas recirculation system which are measured by means of the gas throughflow meter which is connected. By means of these measured values, the control unit generates the standardization data which bring about a relationship between the control signal 22 and the gas throughflow (gas volume flow) which is determined by the gas throughflow meter. At the end of the standardization process, this standardization data is transmitted via the connection 21 to the electronic operating system 20 and stored there in a non-volatile fashion. The control unit and the gas throughflow meter are removed from the setup after this process.

As a result, the electronic operating system 20 is able to adjust the gas volume flow which is necessary during a refuelling process. This is carried out according to the prior art by means of the connection 17 which is shown by dashed lines. The connection 19 which is explained further below is not present according to the prior art. The setup according to the prior art is not as reliable as is necessary since when changes occur, for example due to ageing, the necessary gas volume flow can no longer be generated.

In the setup according to the invention there is an automatic monitoring device with a control unit 15 and a gas volume flow meter 9 in the gas recirculation line 11. The gas volume flow signal 14 is conducted to the control unit 15 together with the fuel volume flow signal 13. Said control unit 15 generates a corrective control signal 19 which actuates the electronic operating system 20 for the recirculation of gas. The connection 17 which is shown by dashed lines is not present in this case. The corrective control signal 19 may be a pulse sequence or a sequence of data words and is adapted to the type of input of the electronic operating system 20; it is preferably in a form such as that of the fuel volume flow signal 13.

If there is a difference between the fuel volume flow signal 13 and gas volume flow system 14 after a refuelling process, the corrective control signal 19 is generated for the following refuelling processes in such a way that the electronic operating system 20 generates a modified gas volume flow 14 which then corresponds again more precisely to the fuel volume flow 13. The corrective control signal 19 therefore corresponds to a pseudo volume flow.

Different fuel volume flows occur in the sequence of refuelling processes since the filling valve 6 has different latching positions. The correction can be different for the different fuel volume flows. For this reason, a correction characteristic which is dependent on the fuel volume flow can be determined as a further improvement.

The gas volume flow is adjusted from one refuelling process to another in accordance with the fuel volume flow, which avoids costly maintenance over a relatively long period of time. It is possible that, for example when there is a total failure of the gas pump 10, it is no longer possible to bring about correspondence. In this case, the control unit 15 can issue an alarm signal to an alarm output 16 and, after the expiry of a configurable tolerance period for the elimination of the error, it can issue a signal which can be used to automatically switch off the respective filling point.

In order to reduce the differences which may occur when there is a statistical error during the measurement of an individual refuelling process, the control unit 15 is preferably configured in such a way that not only the difference between the fuel volume flow 13 and the gas volume flow 14 of the directly preceding refuelling process is used to calculate the correction but also a suitable formation of mean values over a plurality of refuelling processes is used as the basis. This may be in particular a sliding formation of mean values according to the following formulation:

$$A_{N+1}=((M-1)/M)A_{N-1}+(1/M)A_N.$$

Here, M is the number of values over which a sliding average is formed (for example M=10), $A_{N+1}$ is the deviation signal for the chronologically following refuelling process, $A_N$ is the deviation signal which is determined for the given refuelling process and $A_{N-1}$ is the deviation signal which was used during the last refuelling process.

This formation of mean values can be improved further to form a dynamically sliding formation of mean values in that a sliding variance is formed from the sequence of individual deviation signals $A_N$, said variance suitably defining the averaging parameter M. In particular, a larger averaging parameter M has to be selected when there is a relatively large variance.

A further possible way of minimizing the differences between the fuel volume flow signal 13 and the gas volume flow signal 14 as far as possible is to use fuzzy logic. Here, the distribution criteria for the deviation signal from the linguistic variables which approximately represent the system are defined. In particular, it is also possible to define further criteria and evaluate them, for example what degree of adjustment has already been necessary. This parameter can be utilized in order to provide a maintenance indication in an anticipation of a possible error.

A further advantage which the method for corrective control provides is that the possibility described above of throughflow-dependent correction is used to make superfluous standardization by means of an external gas throughflow meter and an external control unit. In this case, basic standardization is carried out only at the manufacturer's works. After installation in the fuel pump, the electronic system carries out complete standardization after an appropriate instruction and does this by adjusting various gas volume flows and storing the values of the measured gas volume flow (gas volume flow signal 14). During a subsequent refuelling process, the control unit 15 can adjust the gas volume flow 14 in accordance with the fuel volume flow 13. As a result, the otherwise customary standardization procedure can therefore be dispensed with. The deficiencies of the gas recirculation system which possibly occur during the further refuelling operation are corrected, as already described above.

The invention claimed is:

1. A method for correctively controlling a gas recirculation system at a filling station at which, during a refuelling process of a motor vehicle, liquid fuel is fed by a fuel pump from a storage tank into a fuel tank of the motor vehicle and a gas mixture located above the fuel in the fuel tank is recirculated into the storage tank by a gas pump, comprising:

generating a fuel volume flow signal by measuring fuel volume flow using a fuel volume flow meter;

generating a gas volume flow signal by measuring gas volume flow using a gas volume flow meter;

generating a corrective control signal for a next refuelling process based on at least the fuel volume flow signal and the gas volume flow signal; and actuating the gas recirculation system to control the gas volume flow based on a previous corrective control signal generated during a previous refuelling process.

2. The method according to claim 1, wherein said generating of the corrective control signal uses a function of an absolute value of the fuel volume flow.

3. The method according to claim 2, wherein said generating of the corrective control signal for the next refuelling process is further based on at least one corrective control signal generated during at least one preceding refuelling process.

4. The method according to claim 3, wherein said generating of the corrective control signal for the next refuelling process comprises calculating mean values of deviation signals over a plurality of refuelling processes, where each deviation signal is a difference between at least one fuel volume flow signal and at least one gas volume flow signal generated during a corresponding refuelling process.

5. The method according to claim 4, wherein each deviation signal is a chronological mean value over the corresponding refuelling process.

6. The method according to claim 5, wherein the mean values are obtained as sliding mean values according to $A_{N+1}=((M-1)/M)A_{N-1}+(1/M)A_N$, where $A_{N+1}$ is the deviation signal for the next refuelling process, $A_N$ is the deviation signal for the corresponding refuelling process, $A_{N-1}$ is the deviation signal used during the previous refuelling process immediately preceding the corresponding refuelling process, and M is a number of values used for the sliding mean values.

7. The method according to claim 6, further comprising calculating a value for M from a sliding variance of a sequence of the deviation signals.

8. The method according to claim 4, wherein the mean values are obtained as sliding mean values according to $A_{N+1}=((M-1)/M)A_{N-1}+(1/M)A_N$, where $A_{N+1}$ is the deviation signal for the next refuelling process, $A_N$ is the deviation signal for the corresponding refuelling process, $A_{N-1}$ is the deviation signal used during the previous refuelling process immediately preceding the corresponding refuelling process, and M is a number of values used for the sliding mean values.

9. The method according to claim 8, further comprising calculating a value for M from a sliding variance of a sequence of the deviation signals.

10. The method according to claim 2, further comprising using linguistic variables to establish a relationship between at least the fuel volume flow signal and the gas volume flow signal on one hand and the corrective control signal on another hand.

11. The method according to claim 1, wherein said generating of the corrective control signal for the next refuelling process is further based on at least one corrective control signal generated during at least one preceding refuelling process.

12. The method according to claim 11, wherein said generating of the corrective control signal for the next refuelling process comprises calculating mean values of deviation signals over a plurality of refuelling processes, where each deviation signal is a difference between at least one fuel volume flow signal and at least one gas volume flow signal generated during a corresponding refuelling process.

13. The method according to claim 12, wherein each deviation signal is a chronological mean value over the corresponding refuelling process.

14. The method according to claim 13, wherein the mean values are obtained as sliding mean values according to $A_{N+1}=((M-1)/M)A_{N-1}+(1/M)A_N$, where $A_{N+1}$ is the deviation signal for the next refuelling process, $A_N$ is the deviation signal for the corresponding refuelling process, $A_{N-1}$ is the deviation signal used during the previous refuelling process immediately preceding the corresponding refuelling process, and M is a number of values used for the sliding mean values.

15. The method according to claim 14, further comprising calculating a value for M from a sliding variance of a sequence of the deviation signals.

16. The method according to claim 12, wherein the mean values are obtained as sliding mean values according to $A_{N+1}=((M-1)/M)A_{N-1}+(1/M)A_N$, where $A_{N+1}$ is the deviation signal for the next refuelling process, $A_N$ is the deviation signal for the corresponding refuelling process, $A_{N-1}$ is the deviation signal used during the previous refuelling process immediately preceding the corresponding refuelling process, and M is a number of values used for the sliding mean values.

17. The method according to claim 16, further comprising calculating a value for M from a sliding variance of a sequence of the deviation signals.

18. The method according to claim 17, further comprising controlling the gas volume flow using at least one of a rotational speed of the gas pump and a throttle valve in a gas recirculation line.

19. The method according to claim 17, further comprising generating an alarm signal if the corrective control signal lies outside a predefined tolerance range.

20. The method according to claim 17, further comprising generating an alarm signal if the corrective control signal lies outside a predefined tolerance range.

21. The method according to claim 1, further comprising using linguistic variables to establish a relationship between at least the fuel volume flow signal and the gas volume flow signal on one hand and the corrective control signal on another hand.

22. An apparatus for correctively controlling a gas recirculation system at a filling station at which, during a refuelling process of a motor vehicle, liquid fuel is fed by a fuel pump from a storage tank into a fuel tank of the motor vehicle and a gas mixture located above the fuel in the fuel tank is recirculated into the storage tank by a gas pump, comprising:

a fuel volume flow meter generating a fuel volume flow signal by measuring fuel volume flow;

a gas volume flow meter generating a gas volume flow signal by measuring gas volume flow; and a control unit generating a corrective control signal for a next refuelling process based on at least the fuel volume flow signal and the gas volume flow signal and actuating the gas recirculation system to control the gas volume flow based on a previous corrective control signal generated during a previous refuelling process.

23. The apparatus according to claim 22, wherein said control unit generates the corrective control signal using a function of an absolute value of the fuel volume flow.

24. The apparatus according to claim 23, wherein said control unit generates the corrective control signal for the next refuelling process is further based on at least one corrective control signal generated during at least one preceding refuelling process.

25. The apparatus according to claim 24, wherein said control unit generates the corrective control signal for the next refuelling process by calculating mean values of deviation signals over a plurality of refuelling processes, where each deviation signal is a difference between at least one fuel volume flow signal and at least one gas volume flow signal generated during a corresponding refuelling process.

26. The apparatus according to claim 25, wherein each deviation signal is a chronological mean value over the corresponding refuelling process.

27. The apparatus according to claim 26, wherein the mean values are obtained as sliding mean values according to $A_{N+1}=((M-1)/M)A_{N-1}+(1/M)A_N$, where $A_{N+1}$ is the deviation signal for the next refuelling process, $A_N$ is the deviation signal for the corresponding refuelling process, $A_{N-1}$ is the deviation signal used during the previous refuelling process immediately preceding the corresponding refuelling process, and M is a number of values used for the sliding mean values.

28. The apparatus according to claim 27, wherein said control unit further calculates a value for M from a sliding variance of a sequence of the deviation signals.

29. The apparatus according to claim 28, wherein said control unit controls the gas volume flow based on a rotational speed of the gas pump.

30. The apparatus according to claim 29, wherein the gas recirculation system includes a gas recirculation line with a throttle valve, and wherein said control unit further controls the gas volume flow using the throttle valve in the gas recirculation line.

31. The apparatus according to claim 30, wherein said control unit further generates an alarm signal if the corrective control signal lies outside a predefined tolerance range.

32. The apparatus according to claim 28, wherein the gas recirculation system includes a gas recirculation line with a throttle valve, and wherein said control unit controls the gas volume flow using the throttle valve in the gas recirculation line.

33. The apparatus according to claim 23, wherein said control unit further uses linguistic variables to establish a relationship between at least the fuel volume flow signal and the gas volume flow signal on one hand and the corrective control signal on another hand.

34. A method for correctively controlling a gas recirculation system at a filling station at which, during a refuelling process of a motor vehicle, liquid fuel is fed by a fuel pump from a storage tank into a fuel tank of the motor vehicle and a gas mixture located above the fuel in the fuel tank is recirculated into the storage tank by a gas pump, comprising:

generating a fuel volume flow signal by measuring fuel volume flow using a fuel volume flow meter;

generating a gas volume flow signal by measuring gas volume flow using a gas volume flow meter;

generating a corrective control signal for a next refuelling process based on at least the fuel volume flow signal and the gas volume flow signal, said corrective control signal being formed as a fuel volume flow signal; and actuating the gas recirculation system to control the gas volume flow based on a previous corrective control signal generated during a previous refuelling process.

* * * * *